US007984806B2

(12) United States Patent
Matheou

(10) Patent No.: US 7,984,806 B2
(45) Date of Patent: Jul. 26, 2011

(54) STACKING UNIT

(76) Inventor: Stefano Matheou, Hove (GB)

( * ) Notice: Subject to any disclaimer, the term of this patent is extended or adjusted under 35 U.S.C. 154(b) by 296 days.

(21) Appl. No.: 10/504,248

(22) PCT Filed: Feb. 11, 2003

(86) PCT No.: PCT/GB03/00685

§ 371 (c)(1),
(2), (4) Date: Aug. 10, 2004

(87) PCT Pub. No.: WO03/068627

PCT Pub. Date: Aug. 21, 2003

(65) Prior Publication Data

US 2005/0103674 A1 May 19, 2005

(30) Foreign Application Priority Data

Feb. 11, 2002 (GB) ..... 0203211.8

(51) Int. Cl.

| | |
|---|---|
| ***B65D 21/00*** | (2006.01) |
| ***B65D 85/20*** | (2006.01) |
| ***B65D 65/00*** | (2006.01) |
| ***A47B 43/00*** | (2006.01) |

(52) U.S. Cl. ..... 206/499; 206/443; 206/427; 211/194

(58) Field of Classification Search ..... 206/0.8, 206/0.83, 0.84, 561, 564, 507, 518, 446, 206/503, 585, 499, 391, 427, 443, 504, 511, 206/821; 211/126.4, 126.3, 126.7, 49.1, 211/55, 74, 194; 220/694, 737; D7/701, D7/707, 708; D6/407, 449, 456, 466
See application file for complete search history.

(56) References Cited

U.S. PATENT DOCUMENTS

| | | | | | |
|---|---|---|---|---|---|
| 1,488,025 | A | * | 3/1924 | Poynter | 211/49.1 |
| 1,780,268 | A | * | 11/1930 | Lyle | 206/433 |
| 1,967,026 | A | * | 7/1934 | Gray et al. | 217/21 |
| 2,018,002 | A | * | 10/1935 | Avery | 211/74 |
| 2,750,028 | A | * | 6/1956 | Bode et al. | 206/585 |
| 3,040,923 | A | * | 6/1962 | Leitzel | 217/26.5 |
| 3,245,570 | A | * | 4/1966 | Friday | 217/26 |
| 3,272,371 | A | * | 9/1966 | Weiner | 206/443 |
| 3,281,003 | A | * | 10/1966 | Pesut, Jr. | 217/26.5 |
| 3,372,812 | A | * | 3/1968 | Parcels | 206/511 |
| 3,589,511 | A | * | 6/1971 | Britt | 206/518 |
| 3,591,032 | A | * | 7/1971 | Baxter | 217/26.5 |

(Continued)

FOREIGN PATENT DOCUMENTS

| | | |
|---|---|---|
| EP | 0 257 177 | 3/1988 |

(Continued)

*Primary Examiner* — J. Gregory Pickett
*Assistant Examiner* — Kaushikkumar Desai
(74) *Attorney, Agent, or Firm* — Fay Sharpe LLP

(57) ABSTRACT

A stacking unit (1) for storing bottles, cans or other articles (7) having circular cross sections comprises a strip (2) of sheet material formed along one side of the strip with at least three part circular cavities (6). The free end walls (5) of the cavities (6) at opposite ends of the strip (2) are of sufficient rigidity to retain the articles in place in the unit under the weight of other articles stacked on the row in the unit. The cavities respectively forming convex wall portions (4) on the opposite side of the strip (2). The stacking unit (1) can be seated on a first row of articles in order to stack a second row of articles on the first row.

27 Claims, 7 Drawing Sheets

U.S. PATENT DOCUMENTS

Figure 1:
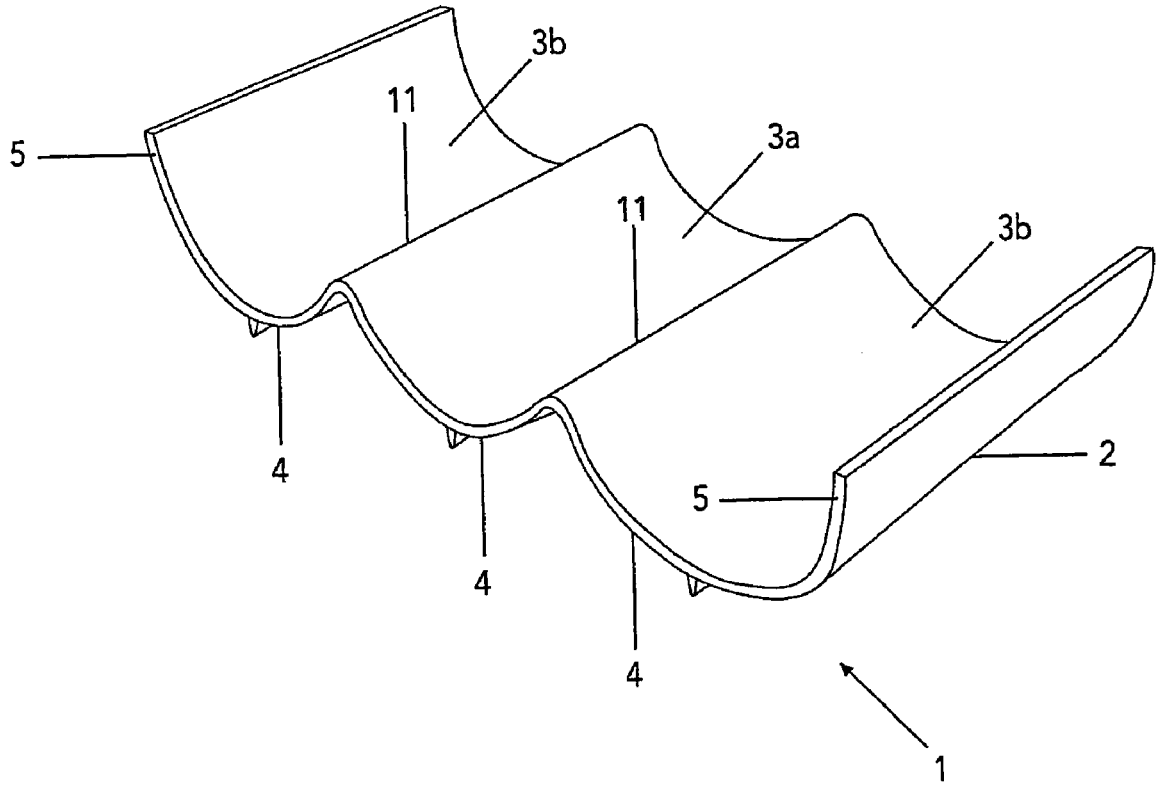

| | | | | | |
|---|---|---|---|---|---|
| 3,732,976 | A | * | 5/1973 | Bessett et al. | 206/499 |
| 3,843,009 | A | * | 10/1974 | Emery | 217/26.5 |
| 3,987,922 | A | * | 10/1976 | Kaira | 217/26.5 |
| 3,997,057 | A | * | 12/1976 | Craig | 206/507 |
| 4,182,455 | A | * | 1/1980 | Zurawin | 211/69.8 |
| 4,660,727 | A | | 4/1987 | Levine | |
| 4,715,492 | A | * | 12/1987 | Holmes | 206/0.83 |
| 4,802,580 | A | * | 2/1989 | Andersen | 206/378 |
| D300,293 | S | * | 3/1989 | Casey | D7/387 |
| 4,860,894 | A | * | 8/1989 | Koenig | 206/421 |
| D353,747 | S | * | 12/1994 | Lanier | D7/701 |
| 5,456,359 | A | * | 10/1995 | Horn | 206/378 |
| D374,582 | S | * | 10/1996 | Chu | D6/513 |
| 5,597,073 | A | * | 1/1997 | Kocis | 206/564 |
| D392,463 | S | * | 3/1998 | Grey | D3/319 |
| D396,408 | S | * | 7/1998 | Carver | D9/758 |
| D414,068 | S | * | 9/1999 | Fells et al. | D6/629 |
| 6,155,433 | A | * | 12/2000 | Anderson et al. | 211/26 |
| D446,092 | S | * | 8/2001 | Cautereels | D7/701 |
| 6,648,138 | B1 | * | 11/2003 | Kelly | 206/315.9 |
| 6,648,154 | B2 | * | 11/2003 | Awalt | 211/85.4 |
| 7,131,544 | B1 | * | 11/2006 | Cunningham | 211/74 |
| 2005/0103674 | A1 | * | 5/2005 | Matheou | 206/503 |

FOREIGN PATENT DOCUMENTS

| | | |
|---|---|---|
| GB | 460 722 | 2/1937 |
| GB | 821 455 | 10/1959 |
| WO | 00 48915 | 8/2000 |

* cited by examiner

STACKING UNIT

This application claims the benefit of PCT Patent Application Ser. No. PCT/GB03/00685, filed on 11 Feb. 2003 and claims the benefit of GB 0203211.8, filed on 11 Feb. 2002, the disclosures of which are incorporated herein by reference.

The present invention relates to a stacking unit enabling bottles, cans or other articles having circular cross sections to be safely and securely stacked in rows one above the other. More particularly, the invention relates to such a stacking unit which enables bottles or cans to be safely stacked in rows one above the other in a domestic refrigerator or cupboard so as to permit maximum use of the available storage space.

Cylindrical articles of similar diameter, such as bottles or cans of beer, need to be stacked both in and out of a refrigerator. Some bottles or cans are too tall to be stood upright in a refrigerator. Where adjustable height racks are provided in a refrigerator, it is often the case that when the racks are moved to accommodate tall cylindrical articles, the heights of the other compartments resulting from the change are too reduced to be useful.

Tall bottles or cans can be stacked on a refrigerator rack on their sides and will stay in place if the stack is braced by one side of the refrigerator and by other items on the other side. However, when an item bracing the stack is removed, the stack will collapse, which may cause damage or create spillage as the collapsing stack disturbs other items on the rack.

Some packs of cans/bottles of drink contain 24 units yet, when the pack is broken to open it, there is no effective means of stacking or storing the bottles/cans in or out of the refrigerator.

Known stacking devices, such as the device disclosed in U.S. Pat. No. 1,780,268, are designed to be used exclusively in packaging and are not self supporting.

An object of the invention is to provide a self supporting stacking unit which holds bottles, cans or like articles side-by-side in a row and which can be used in conjunction with one or more similar units safely and securely to support a multiplicity of the articles in a stack of two or more rows. Another object is to provide such a stacking unit which may be readily packaged, either alone or with other identical units, together with articles intended to be stacked with the aid of the unit(s).

Accordingly, one aspect of the present invention consists in a stacking unit for storing bottles, cans or other articles having circular cross sections, comprising a strip of sheet material formed along one side of the strip with at least three part-circular cavities for holding the articles side-by-side in a row, the free end walls of the cavities at opposite ends of the strip being of sufficient rigidity to retain the articles in place in the unit under the weight of other articles stacked on the row in the unit, and the cavities respectively forming convex wall portions on the opposite side of the strip, whereby the stacking unit can be seated on a first row of articles in order to stack a second row of articles on the first row.

The stacking unit of the present invention allows articles to be stacked side by side in a row in a safe and secure manner and can be used in conjunction with one or more similar units to support a multiplicity of the articles stacked in two or more rows. Advantageously, the stacking unit of the present invention is self-supporting and can therefore be used easily on its own or in conjunction with other similar units without the need to assemble or disassemble parts.

According to another aspect, the present invention consists in a kit of parts for stacking bottles, cans or other articles having circular cross sections, comprising two or more stacking units of the aforementioned structure, whereby a first one of the stacking units can be seated on a horizontal shelf or other surface with its convex wall portions in contact with the surface and can be filled with a first row of articles, and a second one of the units can be seated on the first row of articles held in the first unit, with its convex wall portions disposed between mutually adjacent articles in the first row, and can be filled with a second row of articles, and so on, if there are more than two units, in order to stack the articles in rows one above the other.

The kit may be readily packaged together with articles intended to be stacked with the aid of the unit(s).

The or each strip may be of scalloped configuration in longitudinal section. The cavities of the or each unit may subtend less than a semi-circle. The free end walls of the cavities at the opposite ends of the or each unit may project above the bottoms of the cavities to a height substantially equivalent to the radius of each cavity.

Preferably, each cavity is integral with the or each adjacent cavity via a ridge, the ridges are disposed in a substantially horizontal plane which is spaced above the bottoms of the cavities by a height less than the radii of the cavities, and the free end walls of the cavities at opposite ends of each strip project above said plane.

Conveniently, the configuration is such that articles held in mutually adjacent cavities are in contact. Maximum use of the available storage space can be achieved because no frame is required to build the stacking unit(s) and the articles can be held side-by-side close together or in contact.

The or each unit may be moulded from rigid plastics material or be stamped from a stainless steel strip.

Advantageously, protrusions are disposed at or adjacent to the apices of the convex wall portions to prevent the unit(s) from sliding sideways when the unit is mounted on a storage rack, for example, in a refrigerator.

Figure 2:
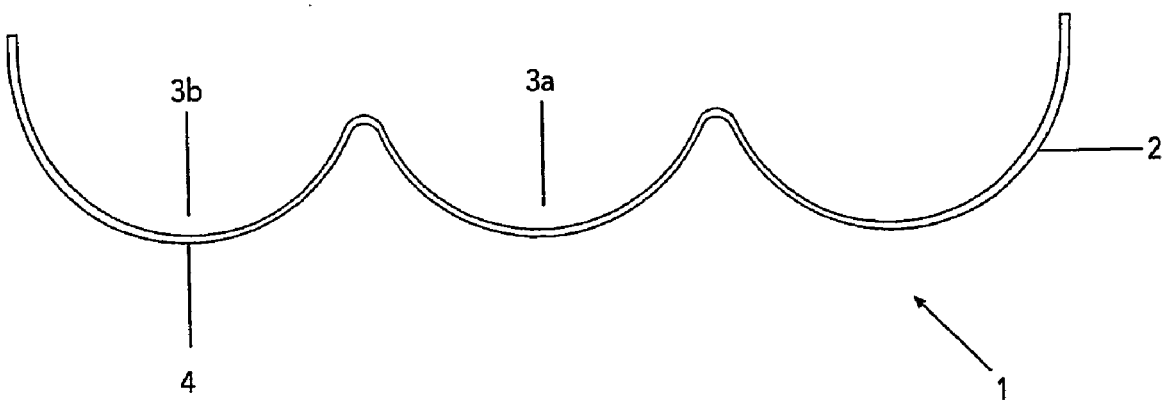
Figure 3:
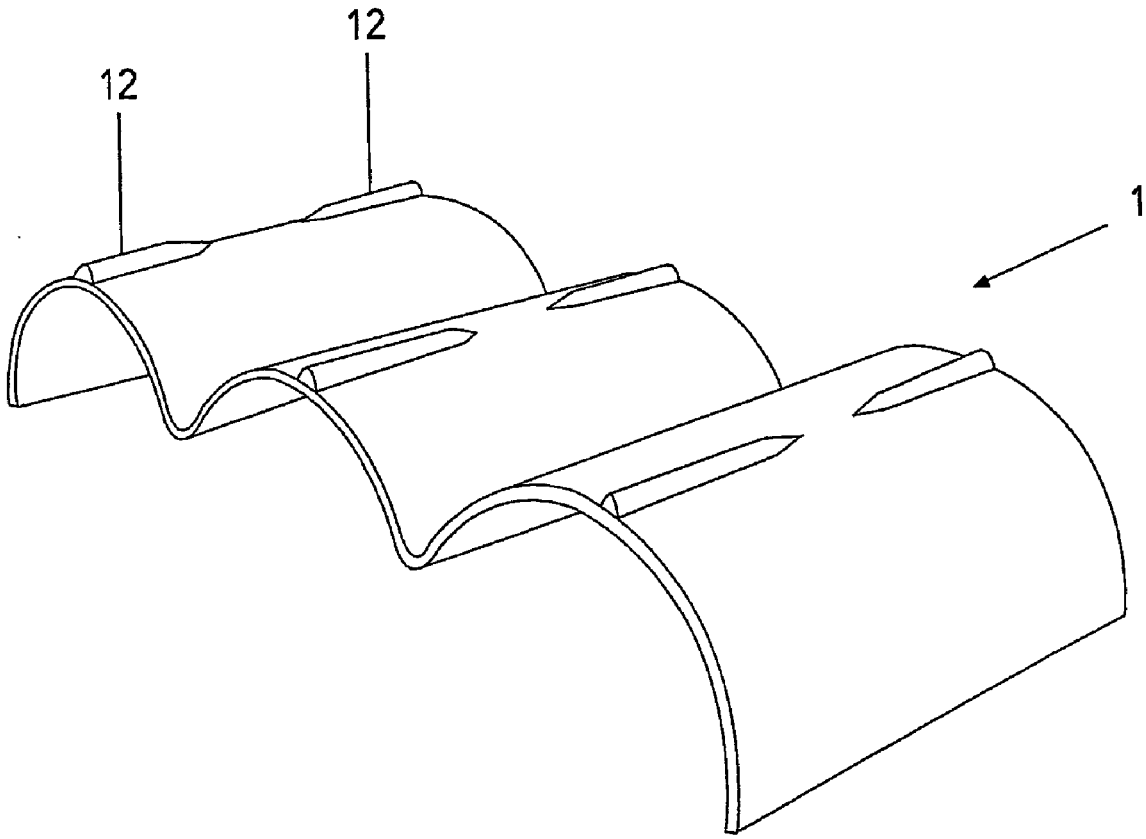
Figure 4:
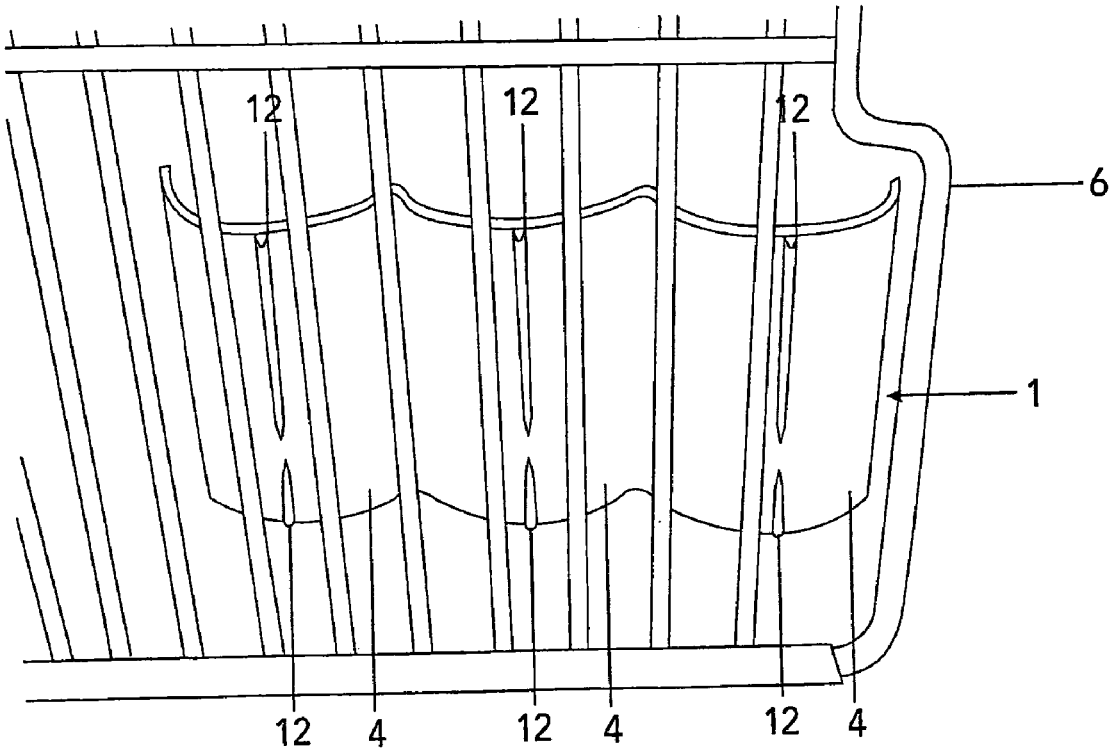
Figure 5:
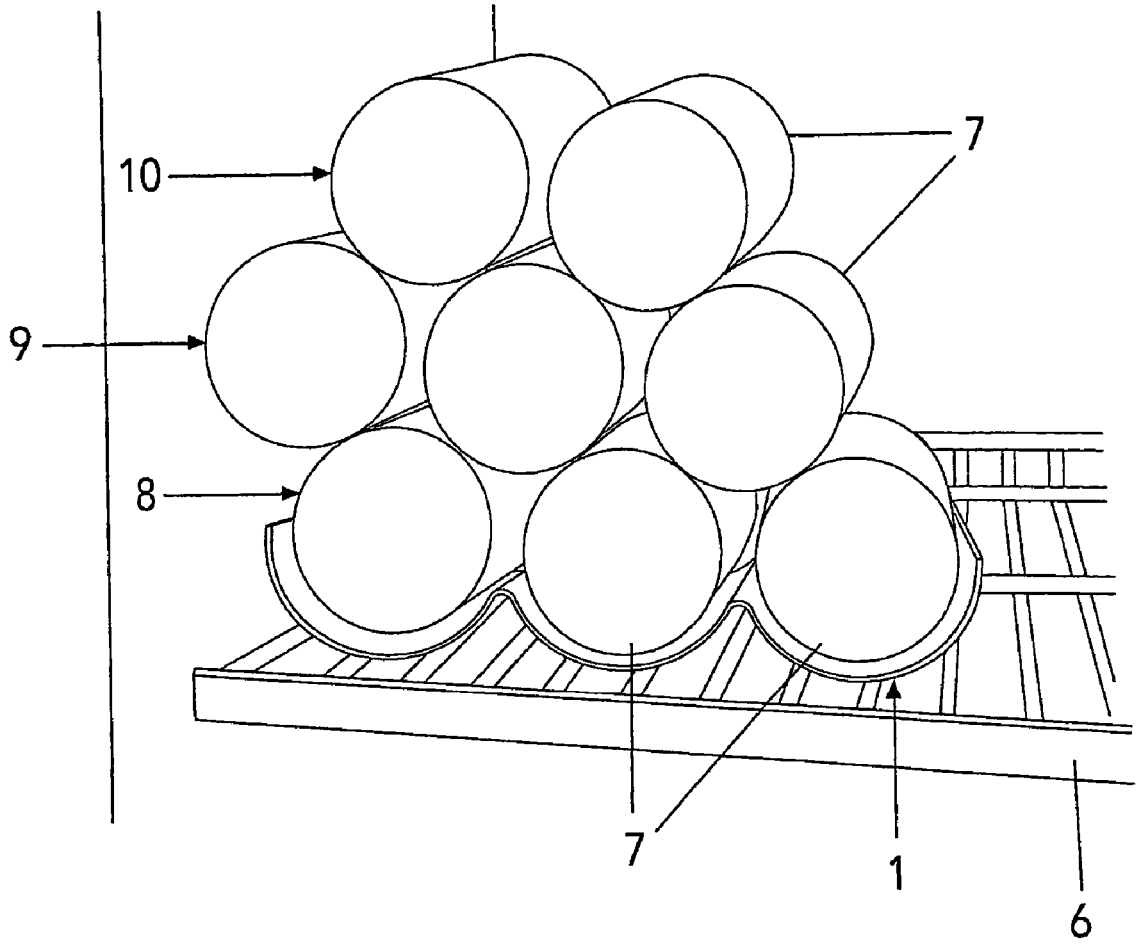
Figure 6:
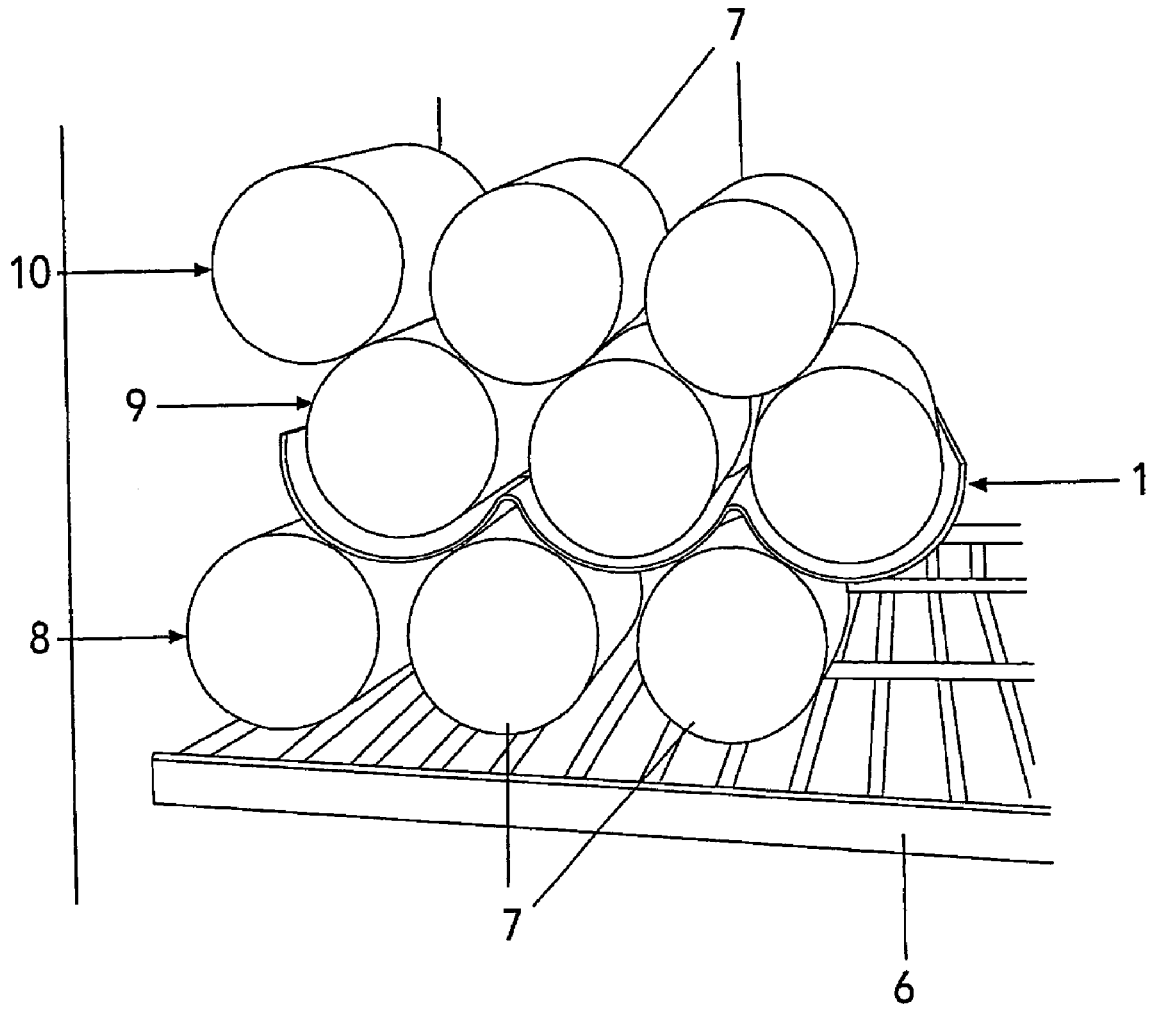
Figure 7:
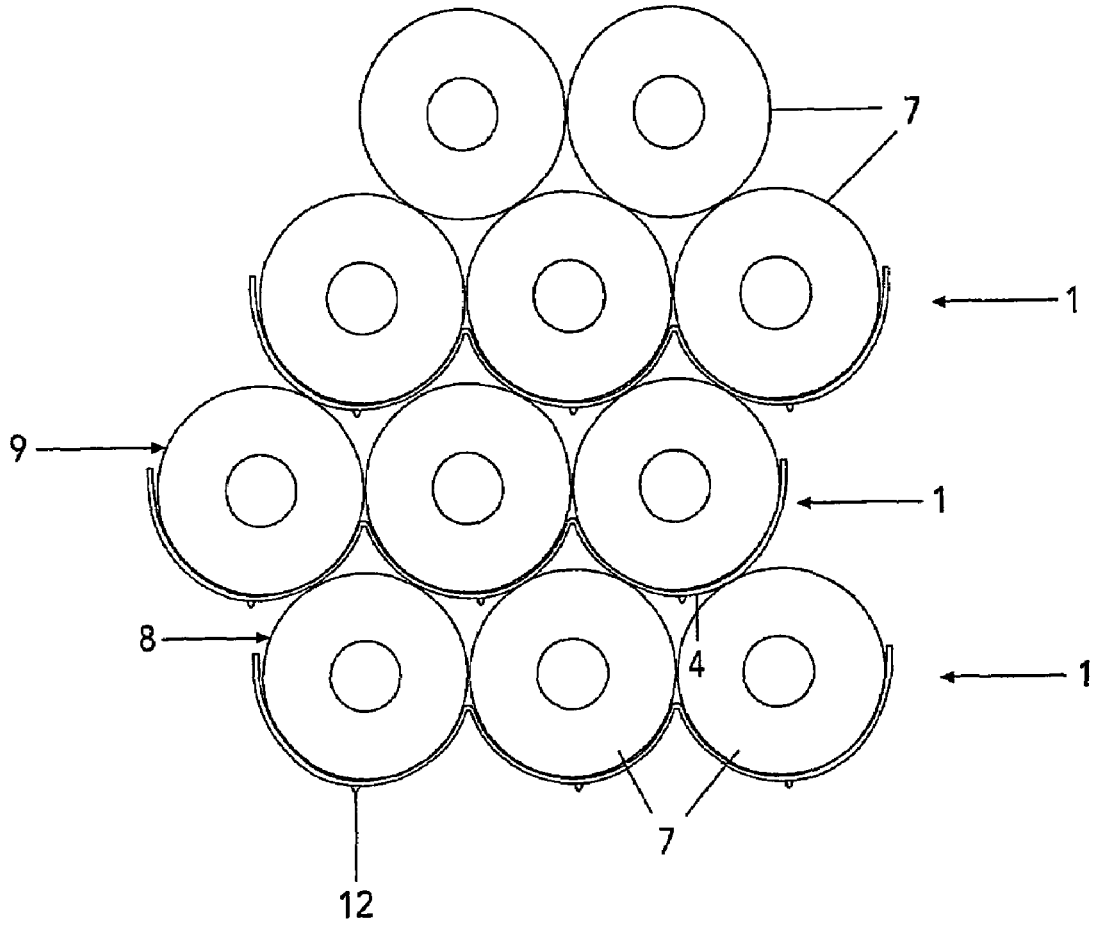

Embodiments of the invention will now be described, by way of example, with reference to the accompanying drawings, in which:

FIG. 1 is a perspective view, from above, of a stacking unit of according to the present invention, FIG. 2 is a side view of the stacking unit shown in FIG. 1, FIG. 3 is a perspective view, from below, of the stacking unit shown in FIG. 1, the unit being inverted, FIG. 4 is a perspective view, from below, of the stacking unit seated on a refrigerator rack, FIG. 5 is a perspective view, from one side, illustrating the stacking unit seated on a refrigerator rack and filled with a first row of bottles, a second row of bottles being stacked on the first row, and a third row being stacked on the second row, FIG. 6 is a perspective view, from one side, illustrating a first row of bottles placed on a refrigerator rack, a stacking unit seated on the first row and filled with a second row of bottles, and a third row of bottles seated on the second row, and FIG. 7 is a side view illustrating three stacking units stacking several rows of bottles.

Referring to FIGS. 1 to 7 of the accompanying drawings, the stacking unit 1 comprises a strip of sheet material 2 which is of scalloped configuration in longitudinal cross section. It is formed along one side of the strip with three part circular cavities 3 having mutually parallel axes. These cavities are designed to hold bottles, cans or other articles 7 having circular cross-sections, side by side in a row. On the opposite side of the strip, the cavities 3 respectively form convex wall portions 4. The strip 2 is preferably injection moulded from rigid plastics material, such as a high-density, high impact polystyrene which is suitable for use in cold, damp or dry conditions such as those to expected in a domestic refrigerator.

As illustrated in FIGS. 1 to 3, the cavities 3 are less than semi-circular in cross section and extend transversely of the strip. The cross-sectional diameters of the cavities 3 are the same and chosen such that when articles are accommodated in mutually adjacent cavities, the articles 7 are held close to or in contact with one another. The width of the strip 2 can be considerably narrower than the length of the bottles because the bottles 7 are held in contact with or close to one another in the unit 1 and so they cannot therefore twist within the unit.

The centre cavity 3*a* is integral with the adjacent cavities 3*b* at opposite ends of the strip 2 via mutually parallel ridges 11 which extend transversely of the strip. The ridges 11 extend in a substantially horizontal plane which is spaced above the bottoms of the cavities 3*a,b* by a height less than the radii of the cavities. The free end walls 5 of the cavities 3*b* at opposite ends of the strip 2 project above this horizontal plane and hence the ridges 11, to a height substantially equivalent to the radii of the cavities. The free end walls 5 of the cavities 3*b* at opposite ends of the strip retain the articles 7 even under the weight of the other articles stacked on the row in the unit 1.

The stacking unit 1 can be filled with a row of articles 7 and then seated on other identical articles stacked side-by-side in a row or on a horizontal shelf or other surface to safely stack rows of articles. For example, as illustrated in FIG. 6, bottles 7 can be placed side by side in a first row 8 on a rack 6 of a domestic refrigerator or cupboard. The stacking unit 1 can then be seated on the first row 8 and filled with second row 9 of bottles 7 to securely stack the second row on the first row.

The rigidity of the free end walls 5 is sufficient to enable the articles 7 to be retained in place in the unit 1 under the weight of other articles 7 stacked in the row in the unit 1. The unit is of sufficient strength to prevent it from failing under the weight of rows of like articles 7 stacked one above the other on the row of articles 7 placed in the unit 1 and is flexible enough to permit the cavities 3*a,b* to accommodate articles having slightly different diameters. For example, when the diameters of the cavities are 59 mm the following articles can be satisfactorily accommodated in the cavities: 275 ml bottles of beer having diameters of 56 mm, 330 ml bottles of beer having diameters of 61 mm, and 440 ml cans of beer having diameters of 66 mm. For cavity diameters of 70-80 mm, articles having diameters of between 66 to 86 mm can be satisfactorily accommodated.

The thickness of the strip 2 depends on the required rigidity, strength and flexibility. For example, if the unit 1 is to be used to stack the 275 ml or 330 ml bottles of beer, a thickness of about 2 mm provides the required rigidity strength and flexlibility when using high-density polystyrene. For heavier and wider articles 7, such as a 750 ml bottle of wine having a diameter of 81 mm, a strip thickness of about 2.5 mm is preferred.

As illustrated particularly in FIGS. 3 and 4, at or adjacent to the lowermost circumference parts of the convex portions 4 and extending transversely of the strip 2 are moulded protrusions 12 to prevent the unit 1 from sliding sideways when the unit is mounted on a rack 6.

In a preferred embodiment, the plastic material is given an attractive high gloss finish using known injection-moulding techniques and the strip may be overprinted with logos, messages or other information.

According to another embodiment, the strip 2 is formed from machine pressed stainless steel and may be laser etched with logos etc or other decorative procedures may be used in the finishing process. In order to achieve the required rigidity, strength and flexibility when used with articles as described in the above examples, the thickness of the stainless steel should be about 0.75 mm.

The method of using the stacking unit 1 for the purpose of stacking articles 7 on a rack 6, for example, of a domestic refrigerator will now be described. As illustrated particularly in FIG. 6, three identical cylindrical articles 7, in this case, bottles, are laid down side-by-side in a first row 8 on the rack 6 of the refrigerator. In order safely and securely to stack a second row of identical bottles 7 on the first row 8, the cavities of the unit 1 are filled with the second row 9 of the bottles 7 with mutually adjacent bottles in contact with or close to one another. The filled stacking unit is then seated on the first row 8 of bottles 7 with two adjacent convex wall portions 4 in contact with and disposed between the surfaces of mutually adjacent bottles 7 of the first row 8 and the third convex wall portion 4 at one of the opposite ends of the strip in contact with and over hanging one of the bottles 7 at the end of the first row 8. The second row 9 of bottles 7 is therefore securely stacked on the first row 8. A third row 10 of bottles is then placed on the second row and so on. Maximum use of the available storage space can be achieved because no frame is required to build the stacking unit(s) 1 and the bottles 7 can be held side-by-side close together or in contact.

Alternatively, as illustrated in FIGS. 4 and 5 the stacking unit 1 can be filled with the first row 8 of bottles 7 and seated directly on the rack 6 of the refrigerator with protrusions 2 disposed between adjacent rails of the rack 6 which are in contact with the convex wall portions. Sideways movement of the unit 1 on the rack is restrained by the protrusions 2 abutting the rails. The first row 8 of bottles 7 is therefore stacked securely on the rack 6 and identical bottles 7 can then be safely laid down side by side on the first row of bottles in a second row 9. A third row 10 of bottles are then placed on the second row and so on. At one end, the resulting stack abuts the adjacent side of the refrigerator to stabilise the stack.

The stacking unit of the present invention allows articles 7 to be stacked side-by-side in a row in a safe and secure manner and can be used in conjunction with one or more similar units 1 to support a multiplicity of the articles 7 stacked in two or more rows 8,9. The stacking unit 1 is self-supporting and can therefore be used easily on its own or in conjunction with other similar units without the need to assemble or disassemble parts.

When not in use, the units 1 can be stacked in nested relation for storage purposes one above the other with the convex wall portions 4 of an upper stacked unit 1 seated in respective cavities 6 of the stacked unit below (not shown).

According to yet another embodiment, the present invention comprises a kit of parts comprising first and second identical stacking units 1 as described in the aforementioned embodiments which, may, for example, be packaged with a 6 pack of identical beer bottles 7. The stacking units 1 are filled with the bottles 7 and then packaged for transportation and storage with the rows of bottles side by side.

When the packaging is removed, the filled units 1 can be directly placed on the rack 6 of a refrigerator so as to stack the bottles 7 as described above.

The invention claimed is:

1. A kit of parts for stacking articles having cylindrical bodies, said kit comprising:

at least two self supporting stacking units, each said stacking unit comprising a strip of sheet material having opposite lateral edges, opposite ends and opposite top and underneath sides between said opposite ends, said strip being formed on said top side between said opposite ends with at least three part cylindrical article-holding cavities extending transversely across said strip in side-by-side relation and from one of said lateral edges to the opposite lateral edge, said part cylindrical article-holding cavities having part-circular cross sections of substantially the same radius and having opposite ends that are open at the lateral edges of the strip, whereby said part-cylindrical article-holding cavities are adapted to hold said articles side-by-side in a row, said opposite ends of the strip terminating in free side walls of the part cylindrical article-holding cavities at said opposite ends, said free side walls being continuations of the respective part-cylindrical article-holding cavities with the same radius as said part-cylindrical cross section and being of sufficient rigidity to retain a first row of said articles in place in the stacking unit under the weight of a second row of articles stacked on said first row of said articles held in said stacking unit, and ridges extending transversely across said strip and integrally joining adjacent said part cylindrical article-holding cavities on said one side of the strip, said ridges having a configuration such that said articles that have a radius that is substantially equal to the radius of said part-circular cross-section and that are held in mutually adjacent said part-cylindrical article-holding cavities, are in contact, said ridges being disposed substantially in a plane spaced above bottoms of the part cylindrical article-holding cavities by a height less than said radius of said part-circular cross section, said free side walls being configured to project above said plane, and said part cylindrical article-holding cavities defining convex wall portions on said underneath side of said strip, whereby a first one of said stacking units is adapted to be placed on a horizontal surface, with said convex wall portions thereof in contact with said horizontal surface, for filling with said first row of the articles, and a second one of said stacking units can be seated on said first row of the articles with said convex wall portions of said second stacking unit disposed between and in contact with mutually adjacent articles of said first row and can be filled with said second row of the articles, and so on when comprising more than two of said stacking units.

2. A kit of parts as claimed in claim 1, including said articles to be stacked by said at least two stacking units.

3. A kit of parts as claimed in claim 1, wherein the side walls of the part cylindrical article-holding cavities at the opposite ends of each strip project above the-bottoms of the part cylindrical cavities to a height substantially equivalent to the radius of said part-circular cross section.

4. A kit of parts as claimed in claim 1, wherein each strip is of scalloped configuration in longitudinal section.

5. A kit of parts as claimed in claim 1, wherein each unit is moulded from rigid plastics material.

6. A kit of parts as claimed in claim 1, wherein protrusions are disposed at or adjacent to the lowermost parts of the convex portions to prevent the units from sliding sideways when seated on a rack.

7. A kit of parts as claimed in claim 1, wherein each stacking unit is configured such that, when not in use, the stacking unit can be stacked on another one of the stacking units with its convex wall portions seated in respective part cylindrical article-holding cavities of the other stacking unit.

8. A self supporting stacking unit for storing articles having a cylindrical bodies, said stacking unit comprising:

a strip of sheet material having opposite lateral edges, opposite ends and opposite top and underneath sides between said opposite ends, said strip being formed on said top side between said opposite ends with at least three part-cylindrical article-holding cavities that extend transversely across said strip in side-by-side relation an from one of said lateral edges to the opposite lateral edge, said part-cylindrical article-holding cavities having part-circular cross-sections of substantially the same radius and having opposite ends that are open at the lateral edges of the strip, whereby said part-cylindrical article-holding cavities are adapted to hold said articles side-by-side in a row, said opposite ends of the strip terminating in free side walls of the part-cylindrical article-holding cavities at said opposite ends, said free side walls being continuations of the respective part-cylindrical article-holding cavities with the same radius as said part-cylindrical cross section and being of sufficient rigidity to retain a first row of said articles in place in the stacking unit under the weight of a second row of said articles stacked on said first row of said articles held in said stacking unit, and ridges extending transversely across said strip and integrally joining adjacent said part-cylindrical article-holding cavities on said top side of the strip, said ridges having a configuration such that said articles that have a radius that is substantially equal to the radius of said part-circular cross-section and that are held in mutally adjacent said part-cylindrical article-holding cavities, are in contact, said ridges being disposed substantially in a plane that is spaced above bottoms of said part-cylindrical article-holding cavities by a height less than said radius of said part-circular cross-section, said free side walls being configured to project above said plane that have substantially the same radius as said part-cylindrical cross-section, and said part-cylindrical article-holding cavities defining convex wall portions on the underneath side of said strip such that said stacking unit can be seated on a third row of said articles positioned therebeneath with said convex wall portions between and in contact with mutually adjacent articles of said third row of said articles.

9. A unit as claimed in claim 8, wherein the free side walls of the part cylindrical article-holding cavities at the opposite ends of the strip project above the bottoms of the part cylindrical article-holding cavities to a height substantially equivalent to the radius of said part-circular cross section.

10. A unit as claimed in claim 8, wherein the strip is of scalloped configuration in longitudinal section.

11. A unit as claimed in claim 8, wherein each unit is moulded from rigid plastics material.

12. A unit as claimed in claim 8, wherein protrusions are disposed at or adjacent to lowermost parts of the convex portions to prevent the unit from sliding sideways when seated on a rack.

13. A unit as claimed in claim 8, wherein the unit is configured such that, when not in use, it can be stacked on another like stacking unit with its convex wall portions seated in respective part cylindrical article-holding cavities of the other stacking unit.

14. A package comprising:

a plurality of like articles having cylindrical bodies and arranged side-by-side in at least two rows of said like articles, and at least one self supporting stacking unit comprising:

a strip of sheet material having opposite lateral edges, opposite ends and opposite top and underneath sides between said opposite ends, said strip being formed on said top side between said opposite ends with at least three part cylindrical article-holding cavities extending transversely across said strip in side-by-side relation and from one of said lateral edges to the opposite lateral edge, said part cylindrical article-holding cavities having part-circular cross sections of substantially the same radius and having opposite ends that are open at the lateral edges of the strip, whereby said part-cylindrical article-holding cavities are adapted to hold said like articles side-by-side in a row, said opposite ends of the strip terminating in free side walls of the part cylindrical article-holding cavities at said opposite ends, said free side walls being continuations of the respective part-cylindrical article-holding cavities with the same radius as said part-cylindrical cross section and being of sufficient rigidity to retain a first row of said articles in place in the stacking unit under the weight of a second row of said like articles stacked on said first row of said like articles held in said stacking unit, and ridges extending transversely across said strip and integrally joining adjacent said part cylindrical article-holding cavities on said top side of the strip, said ridges having a configuration such that said like articles that have a radius that is substantially equal to the radius of said part-circular cross-section and that are held in mutually adjacent said part-cylindrical article-holding cavities, are in contact, said ridges being disposed substantially in a plane spaced above bottoms of the part cylindrical article-holding cavities by a height less than said radius of the said part circular cross-section, said free side walls being configured to project above said plane, and said part cylindrical article-holding cavities defining convex wall portions on said underneath side of said strip such that said strip can be seated on a third row of said like articles positioned therebeneath with said convex wall portions between and in contact with mutually adjacent like articles of said third row of articles, and at least said first row of like articles being disposed in the part cylindrical article-holding cavities of said at least one stacking unit.

15. A package as claimed in claim 14, including a third row of said articles engaging the convex wall portions of said strip.

16. A package as claimed in claim 14, wherein the configuration and height of the ridges are arranged to enable articles disposed in said part cylindrical article-holding cavities to be held close to or in contact with one and another.

17. A package as claimed in claim 14, wherein said side walls of the part cylindrical article-holding cavities at the opposite ends of the strip of said at least one stacking unit project above the bottoms of the part cylindrical article-holding cavities to a height substantially equivalent to a radius of said part-circular cross section.

18. A package as claimed in claim 14, wherein the strip of said at least one stacking unit is of scalloped configuration in longitudinal section.

19. A package as claimed in claim 14, wherein said at least one stacking unit is moulded from rigid plastics material.

20. A package as claimed in claim 14, wherein protrusions are disposed at or adjacent to lowermost parts of the convex portions to prevent said at least one stacking unit from sliding sideways when seated on a rack.

21. A package as claimed in claim 14, wherein said at least one stacking unit is configured such that, when not in use, it can be stacked on another like stacking unit with its convex wall portions seated in respective part cylindrical article-holding cavities of said other stacking unit.

22. A stacking unit storing articles having cylindrical bodies of a predetermined radius, said stacking unit comprising:

a plurality of articles, a stacking strip of sheet material having opposite lateral edges, opposite ends and opposite top and underneath sides between said opposite ends, said stacking strip being formed on said top side between said opposite ends with at least three article-holding cavities that extend transversely across said stacking strip in side-by-side relation and from one of said lateral edges to the opposite lateral edge, said article-holding cavities having substantially the same cross sections and having opposite ends that are open at the lateral edges of the stacking strip, said article-holding cavities holding a first row of said articles in side-by-side relation, said opposite ends of the stacking strip terminating in free side walls of said article-holding cavities at said opposite ends that retain said first row of said articles in place in the stacking strip under the weight of a second row of said articles stacked on said first row of said articles held in said stacking strip, said free side walls being of a configuration and sufficient rigidity to retain said first and second rows, and ridges extending transversely across said stacking strip and integrally joining adjacent said article-holding cavities on said top side of the stacking strip, said ridges being disposed substantially in a plane that is spaced above bottoms of said cavities by a height less than said predetermined radius of the cylindrical body of a said article stacked in said stacking strip, said ridges having a configuration and height permitting said articles disposed in said article-holding cavities to be in contact with one another, said free side walls of the article-holding cavities being configured to project above said plane, and said article-holding cavities defining wall portions on the underneath side of said stacking strip, said wall portions being configured such that said stacking strip can be seated on a third row of said articles positioned therebeneath.

23. A stacking strip as claimed in claim 22, wherein said free side walls of the article-holding cavities at the opposite ends of said stacking strip project above the bottoms of said article-holding cavities to a height substantially equivalent to said predetermined radius of said cylindrical bodies of said articles.

24. A stacking system as claimed in claim 22, wherein said stacking strip is of scalloped configuration in longitudinal section.

25. A stacking system as claimed in claim 22, wherein said stacking strip moulded from rigid plastics material.

26. A stacking system as claimed in claim 22, wherein said stacking strip is configured such that, when not in use, it can be stacked on another like stacking strip with its said wall portions on said underneath side seated in respective article-holding cavities of said other stack strip.

27. A stacking system as claimed in claim 22, wherein said articles are bottles and said stacking strip has a width between said opposite lateral edges thereof which is narrower than lengths of said bottles.

* * * * *